US008637756B1

(12) United States Patent
Brawley

(10) Patent No.: US 8,637,756 B1
(45) Date of Patent: Jan. 28, 2014

(54) MULTI-LAYERED BRASS AND WOODWIND INSTRUMENT COVER

(76) Inventor: Pamela Brawley, Oakland, CA (US)

( * ) Notice: Subject to any disclaimer, the term of this patent is extended or adjusted under 35 U.S.C. 154(b) by 0 days.

(21) Appl. No.: 13/563,704

(22) Filed: Jul. 31, 2012

(51) Int. Cl.
*G10D 9/00* (2006.01)

(52) U.S. Cl.
USPC ..... 84/453

(58) Field of Classification Search
USPC ..... 84/327, 329, 453; 206/314
See application file for complete search history.

(56) References Cited

U.S. PATENT DOCUMENTS

| | | | | |
|---|---|---|---|---|
| 3,230,814 | A | 1/1966 | Welts | |
| 4,084,477 | A | 4/1978 | Dominguez | |
| 5,219,075 | A * | 6/1993 | White | 206/314 |
| 7,090,313 | B1 | 8/2006 | McMurray | |
| 7,453,034 | B2 | 11/2008 | Johnson | |
| 7,488,881 | B2 | 2/2009 | Kessler | |
| 7,671,264 | B1 | 3/2010 | Heda | |
| 7,956,270 | B1 * | 6/2011 | Burmeister et al. | 84/453 |
| 8,087,513 | B2 | 1/2012 | Kriesel | |
| 2002/0011389 | A1 | 1/2002 | Intini | |
| 2006/0027472 | A1 | 2/2006 | Gokcen | |
| 2008/0216633 | A1 | 9/2008 | Winch | |
| 2008/0230413 | A1 | 9/2008 | Taninbaum | |
| 2010/0122755 | A1 | 5/2010 | Post | |
| 2010/0170811 | A1 | 7/2010 | Coppiardi | |
| 2011/0088532 | A1 | 4/2011 | Klemp | |
| 2011/0253568 | A1 | 10/2011 | Wright | |

* cited by examiner

*Primary Examiner* — Kimberly Lockett
(74) *Attorney, Agent, or Firm* — Ariel S. Bentolila; Bay Area IP Group, LLC

(57) ABSTRACT

A multi-layered instrument cover protects an instrument against damage. The cover can encapsulate the instrument fully assembled, so that a user only has to remove the cover to utilize the instrument. The cover includes multiple layers that provide various functions. An inner layer is fabricated from a soft material suitable for contacting the instrument. An intermediate layer overlays the inner layer, and has sufficient rigidity to provide protection and a shape to the cover. The shape of the cover can conform to the instrument. An exterior layer provides an exterior surface that can be decorative and also help to identify the instrument. The exterior layer and the intermediate layer can be sewn onto the inner layer. Pouches on the exterior layer contain instrument components such as mouth pieces, tuners, and sheet music. A handle on the exterior layer orients and positions the cover on and/or off the instrument.

20 Claims, 15 Drawing Sheets

FIG. 2B
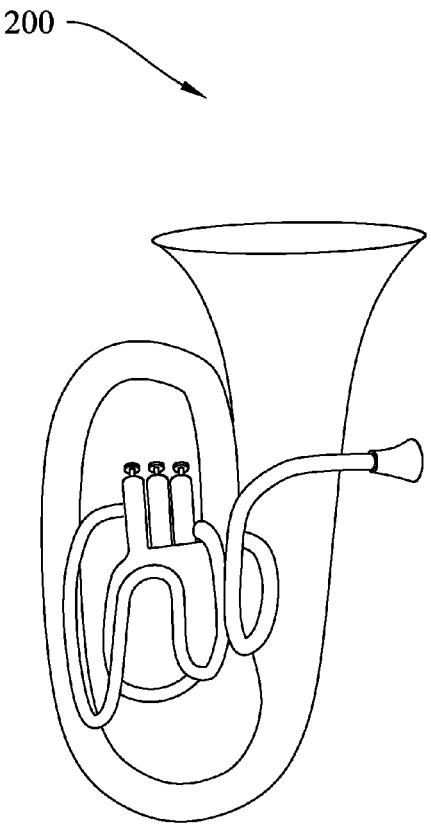
FIG. 2D
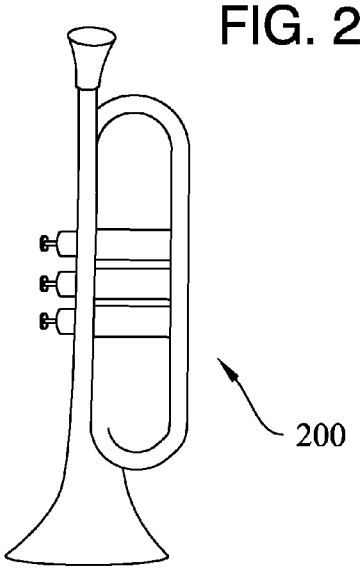
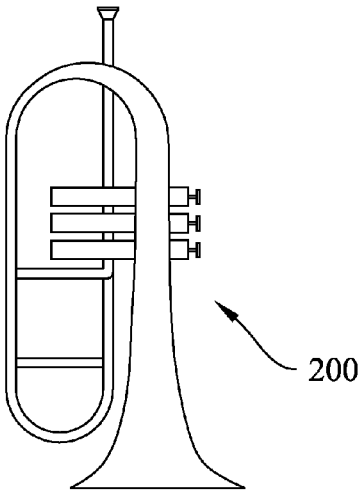
FIG. 2C

FIG. 2E
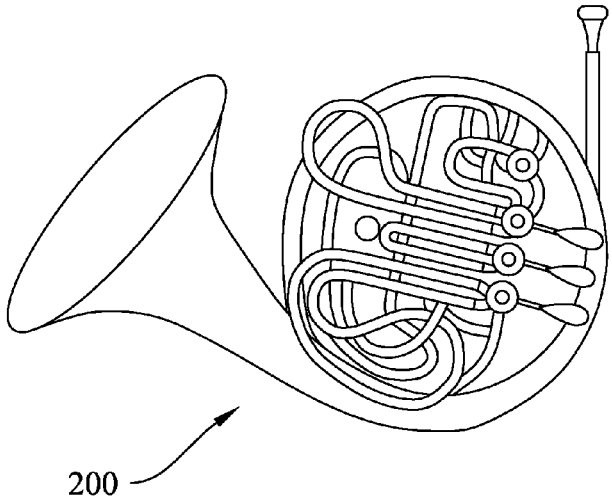
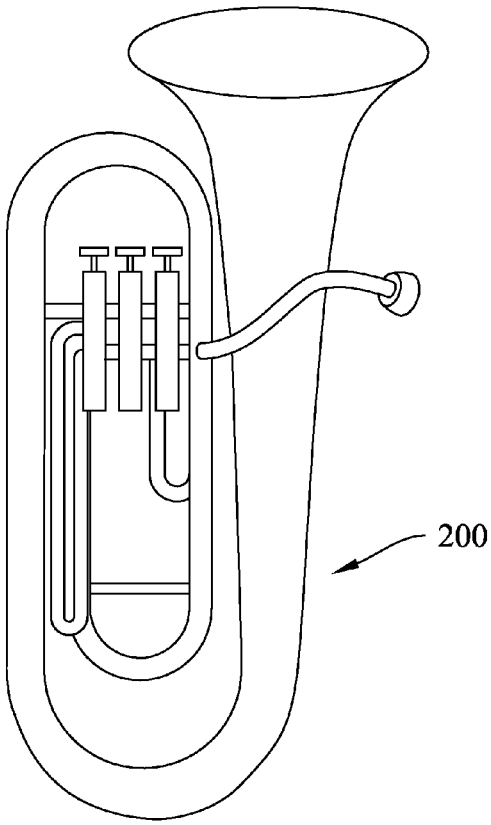
FIG. 2F

MULTI-LAYERED BRASS AND WOODWIND INSTRUMENT COVER

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to protective covers. More particularly, one or more embodiments of the invention relate to brass and woodwind instrument covers.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a musical instrument is a device created or adapted for the purpose of making musical sounds. In principle, any object that produces sound can serve as a musical instrument—it is through purpose that the object becomes a musical instrument.

Typically, instrument cases serve as essential protection and covering for instruments during transportation and/or storage. Some cases provide protection from weather changes or environments that may be hazardous to the instrument. The instrument must often be disassembled prior to compacting into the instrument case. The instrument case is often rigid and provides more of a permanent storage for the instrument.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A illustrates an exemplary cylindrical shape instrument cover configured for a piccolo, flute, oboe, english horn, clarinet, and straight soprano saxophone. FIG. 1B illustrates an exemplary instrument cover configured for a curved saxophone without neck and mouthpiece, FIG. 1C illustrates an exemplary instrument cover configured for a saxophone with neck and mouthpiece, FIG. 1D illustrates an exemplary curved saxophone with neck and mouthpiece, FIG. 1E illustrates an exemplary clarinet, FIG. 1F illustrates an exemplary instrument flute, FIG. 1G illustrates an exemplary piccolo, FIG. 1H illustrates an exemplary straight soprano saxophone, and FIG. 1I illustrates an exemplary n English horn, in accordance with an embodiment of the present invention;

FIGS. 2A, 2B, 2C, 2D, 2E, and 2F, 2G, and 2H illustrate detailed perspective views of a multiplicity of various exemplary instruments, in accordance with an embodiment of the present invention, where FIG. 2A illustrates an exemplary trombone trumpet, FIG. 2B illustrates an exemplary tuba, FIG. 2C illustrates an exemplary flugel horn, FIG. 2D illustrates an exemplary trumpet, FIG. 2E illustrates an exemplary French horn, and FIG. 2F illustrates an exemplary euphonium, FIG. 2G illustrates an exemplary bassoon, and 2H illustrates an exemplary trombone euphoneum in accordance with an embodiment of the present invention;

FIG. 3A illustrates a bottom view of an empty exemplary instrument cover, FIG. 3B illustrates a top view of an exemplary instrument inside an exemplary instrument cover, without exemplary top for viewing purposes and FIG. 3C illustrates top of the cover with a handle in accordance with an embodiment of the present invention;

FIG. 4A illustrates a top view with an exemplary handle, and FIG. 4B illustrates a bottom view with access to an exemplary inner layer, in accordance with an embodiment of the present invention;

Figure 1A:
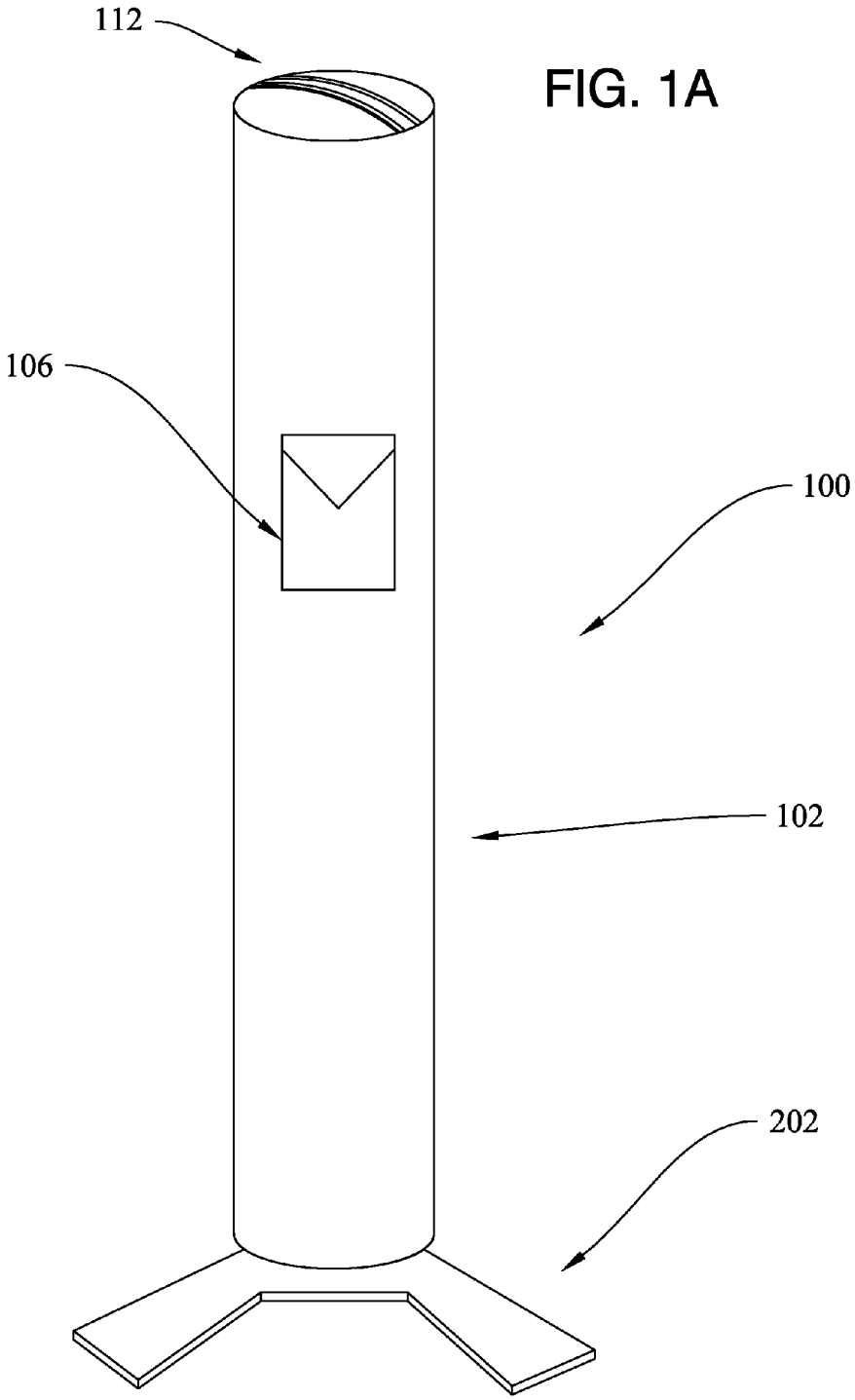
FIGS. 1A, 1B, 1C, 1D, 1E, 1F, 1G, 1H, and 1I illustrate detailed perspective views of various sizes and dimensions of exemplary instruments and exemplary instrument covers for various instruments, where

Unless otherwise indicated illustrations in the figures are not necessarily drawn to scale.

DETAILED DESCRIPTION OF SOME EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. Thus, the present invention is not limited to any particular tangible means of implementation.

The present invention will now be described in detail with reference to embodiments thereof as illustrated in the accompanying drawings.

There are various types of instrument covers 100 that may be provided by preferred embodiments of the present invention. In some embodiments, the instrument cover 100 may provide a multi-layered cover that protects the instruments against damage, including, without limitation, scratching, denting, chipping, tarnishing, dust, and some mild temperature variances. The instrument cover may utilize the multi-layered cover, with each layer providing a specific function to protect the instrument. In one embodiment of the present invention, the instrument cover may be configured to cover an instrument 200 without requiring that the instrument be disassembled. In this manner, a fully assembled, ready to play instrument may be visibly positioned on an instrument stand 202 for facilitated accessibility and availability. Also, by covering the instrument while fully assembled, the instrument may withstand less attrition to the joints and components from repetitive assembling and disassembling.

In one embodiment of the present invention, the instrument cover may include a body portion 102 that encapsulates the instrument. The body portion may include one whole piece, or multiple sections that join together around the instrument. In some embodiments, the body portion may include a multiplicity of material layers and components that create a synergy to provide protection, accessibility, and aesthetics to the instrument cover. The body portion may include an inner layer 104 for engaging the instrument. The inner layer may include a soft material that will not damage the instrument. In one embodiment of the present invention, the body portion may include at last one intermediate layer 108 for insulating and retaining the form and contour of the instrument cover. Those skilled in the art, in light of the present teachings will recognize that the intermediate layer may be configured to conform to multiple sizes, shapes, and dimensions of instruments, including, without limitation woodwinds, and brass instruments. In one embodiment of the present invention, the body portion may include an exterior layer 110 for providing an exterior surface to the instrument cover. The exterior layer may include both functional and aesthetic features. The exterior layer 110 may include at least one pouch 106 for holding instrument components, including, without limitation, a reed case, a mouthpiece, and a tuner. In one embodiment of the present invention, the exterior layer may include a handle 112 for orienting and positioning the instrument cover on and/or off of the instrument.

Figure 1B:
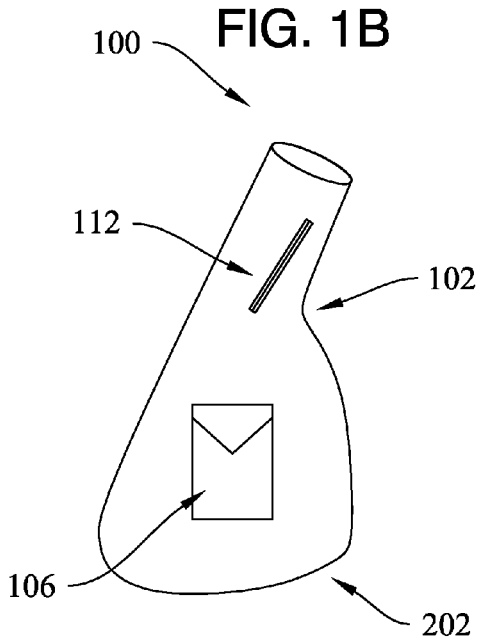
Figure 1C:
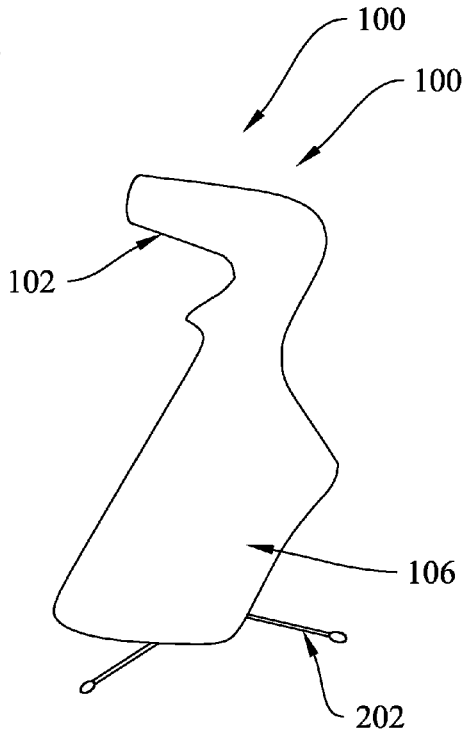
Figure 1D:
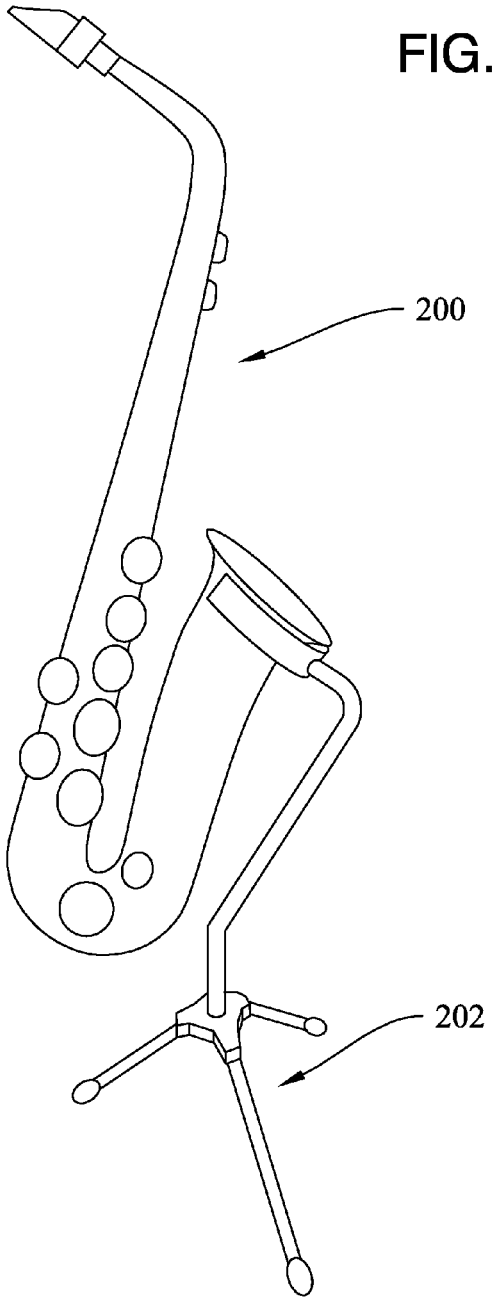
Figure 1E:
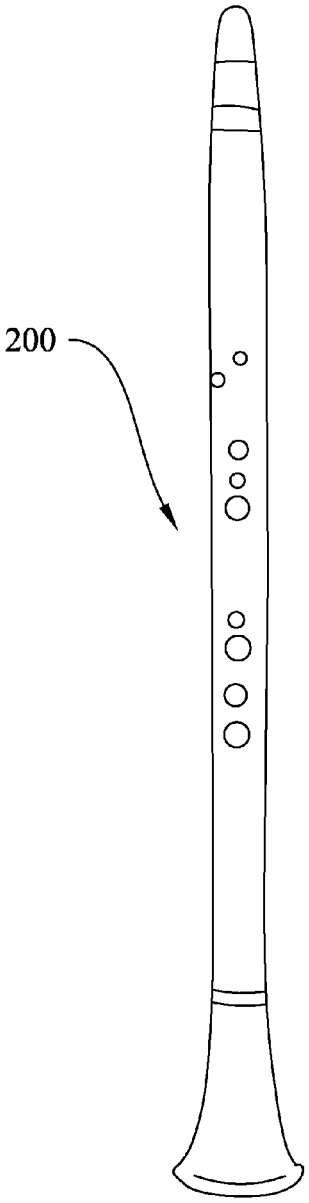
Figure 1F:
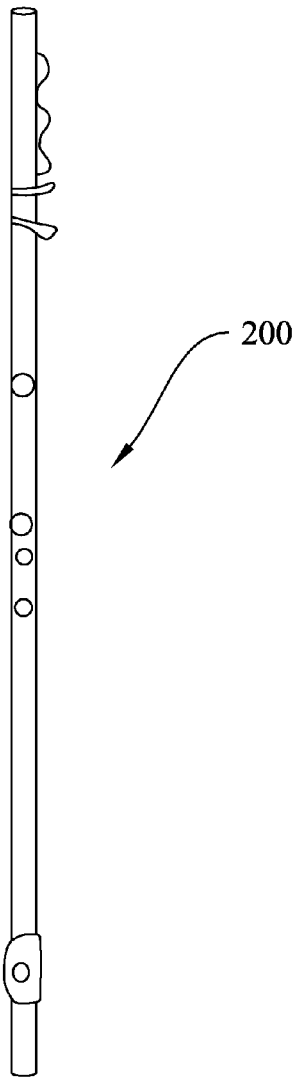
Figure 1G:
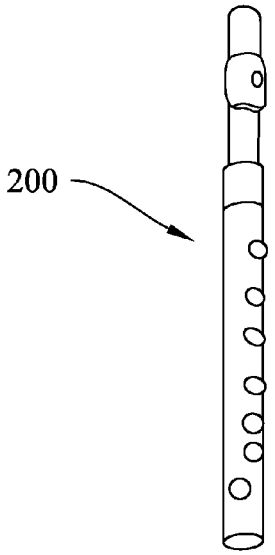
Figure 1I:
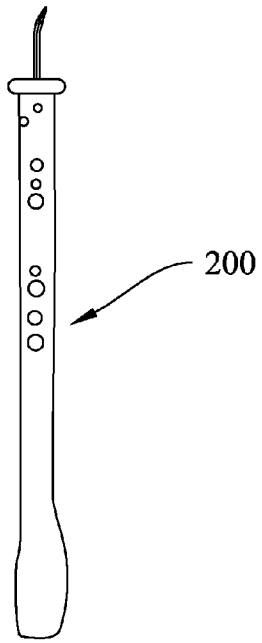
Figure 1H:
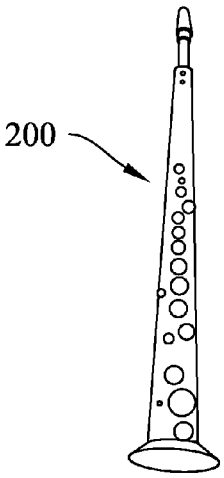

FIGS. 1A, 1B, 1C, 1D, 1E, 1F, 1G, 1H, and 1I illustrate detailed perspective views of various sizes and dimensions of exemplary instruments and exemplary instrument covers for various instruments, where FIG. 1A illustrates an exemplary cylindrical shape instrument cover configured for a piccolo, flute, english horn, oboe, clarinet, and straight soprano saxophone FIG. 1B illustrates an exemplary instrument cover configured for a curved saxophone without neck and mouthpiece, FIG. 1C illustrates an exemplary instrument cover configured for a saxophone, FIG. 1D illustrates an exemplary instrument curved saxophone with neck and mouthpiece, FIG. 1E illustrates an exemplary clarinet, FIG. 1F illustrates an exemplary flute, FIG. 1G illustrates an exemplary piccolo, FIG. 1H illustrates an exemplary straight soprano saxophone, and FIG. 1I illustrates an exemplary n English horn, in accordance with an embodiment of the present invention. In one embodiment of the present invention, the instrument cover 100 may provide a multi-layered cover that protects the instruments against damage, including, without limitation, scratching, denting, chipping, tarnishing, moisture, dust, and mild temperature variances. The instrument cover may utilize the multi-layered cover, with each layer providing a specific function to protect the instrument. In some embodiments, the instrument cover may provide less rigid protection than a typical instrument case, yet provide greater flexibility for positioning the instrument inside and retaining the instrument in an assembled configuration. In this manner, a fully assembled, ready to play instrument may be visibly positioned on an instrument stand for facilitated accessibility and availability. Those skilled in the art, in light of the present teachings will recognize that when the instrument is fully assembled and easily accessible through a soft cover, such as the instrument cover, a user may have greater incentive to utilize the instrument. In one embodiment of the present invention, the instrument cover may include a body portion that overlays over the instrument. In some embodiments, the body portion may encapsulate the instrument. The body portion may be shaped to conform to various instruments. For example, without limitation, a cylindrical shaped body portion may cover clarinet, a rectangular shaped body portion may cover a trombone, and an oval shaped body portion may cover a trumpet.

In some embodiments, the body portion may include one whole piece, or multiple sections that join together around the instrument. In some embodiments, the body portion may conform to the shape and size of the instrument. For example, without limitation, the body portion may cover a long instrument such as a saxophone. The body portion may include a neck portion to cover the top of the saxophone, and a body portion to cover the body of the saxophone and the instrument with which it rests on. The neck portion and the body portion may separate and then reattach over the instrument with fasteners, including, without limitation, Velcro, a stitching, a zipper, an adhesive, magnets, snap buttons, clamps, and pins. In some embodiments, the body portion may include a multiplicity of material layers and components that create a synergy to provide protection, accessibility, and aesthetics to the instrument cover. In one embodiment of the present invention, a lower inside portion of the body may include a moisture and/or odor absorbing portion to further protect the instrument, including, without limitation, a gel silica pack and baking soda.

In one embodiment of the present invention, the instrument cover may include an inner layer for engaging the instrument. The inner layer may provide a close, but not fully snug fit over the instrument. In this manner, the instrument cover may not snag or excessively rub against the instrument. The inner layer may include a soft material that will not damage the instrument. Suitable materials for the inner layer may include, without limitation, a fleece, an anti-tarnishing fabric, and cotton. In one embodiment of the present invention, the outer layer may include at least one pouch for holding and protecting instrument components, including, without limitation, a reed case, a mouthpiece, and a tuner. However, the at least one pouch may further include a plethora of other items associated with music, including, without limitation, sheet music. The at least one pouch may also protect these items with a moisture and/or odor absorbing portion, such as, without limitation, a gel silica pack and baking soda.

In one embodiment of the present invention, the instrument cover may include at last one intermediate layer for insulating and retaining the form of the instrument cover. The at least one intermediate layer may provide the overall shape of the instrument cover, thereby providing the identification and instrument functionality for the instrument cover. Those skilled in the art, in light of the present teachings will recognize that the at least one intermediate layer may be configured to conform to multiple sizes, shapes, and dimensions of instruments, including, without limitation woodwinds, and brass. Suitable materials for the at least one intermediate layer may include, without limitation, polyether urethane, foam, plastic, polyvinyl chloride (pvc), silicone, and gel. In one embodiment, the at least one intermediate layer may include a ½" polyether urethane shell. In yet another embodiment, the at least one intermediate layer may include between ⅜" to ⅝" of foam. Those skilled in the art, in light of the present teachings will recognize that the at least one intermediate layer may include one, two, three, four, or more layers, depending on the required malleability and protection for the instrument. Various other factors in determining the amount of intermediate layers may include, without limitation, weight, strength, flexibility, and type of instrument. For example, without limitation, a flute may require a simple foam intermediate layer to prevent the keys from moving excessively, while a tuba may require a more rigid intermediate layer to protect against accidental fall from music stand.

In one embodiment of the present invention, the instrument cover may include an exterior layer for providing an exterior surface to the instrument cover. The exterior layer may include both functional and aesthetic features. The exterior layer may include various textures efficacious for resisting bacteria, providing grip, facilitating visibility, and classifying different instruments. For example, without limitation, a yellow exterior surface may be utilized for brass instruments, and a brown exterior surface may be utilized for woodwind instruments. In some embodiments, the exterior surface may include decorative features, including, without limitation, graphics, colors, various textures, logos, text, and illumination. In one alternative embodiment, the exterior surface may include a reflective surface for deflecting the rays of the sun. In one embodiment of the present invention, the exterior layer may include a handle for orienting and positioning the instrument cover on or off of the instrument. In one embodiment, the exterior layer may include the at least one pouch for holding and protecting instrument components, including, without limitation, a reed case, a mouthpiece, and a tuner.

Figure 2A:
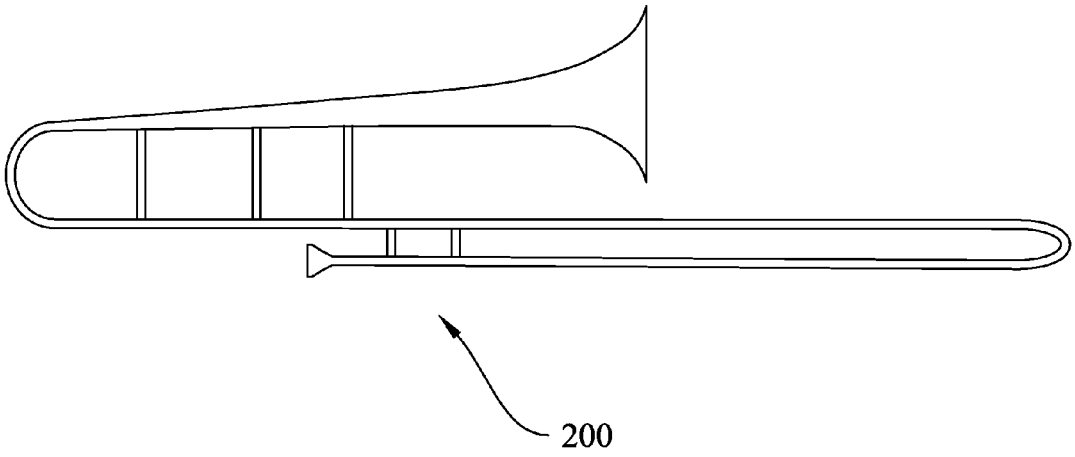
Figure 2G:
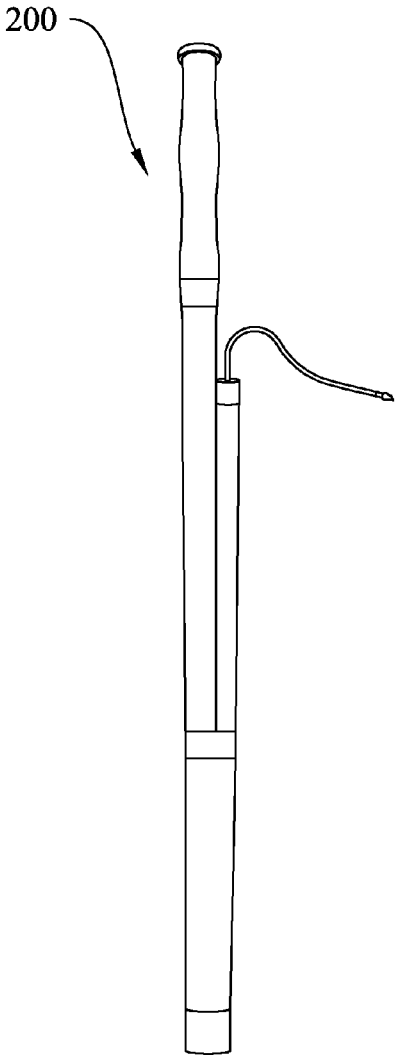
Figure 2H:
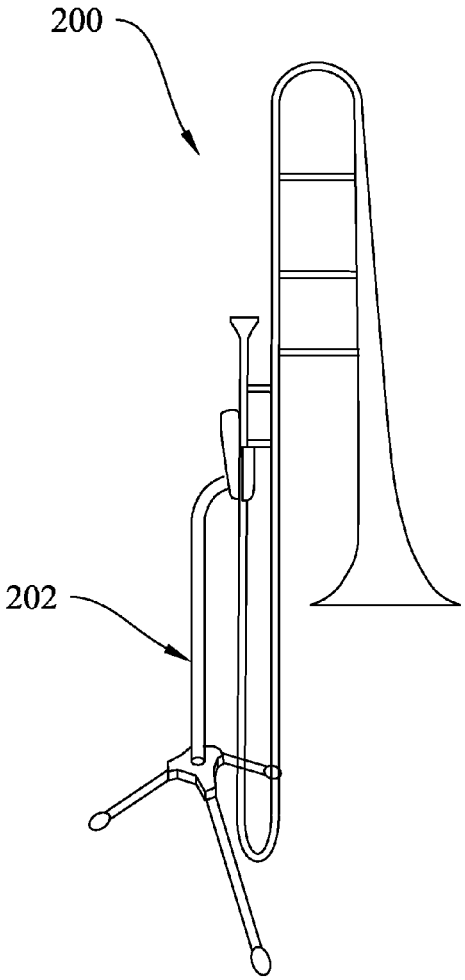

FIGS. 2A, 2B, 2C, 2D, 2E, 2F, 2G, and 2H2F illustrate detailed perspective views of a multiplicity of various exemplary instruments, in accordance with an embodiment of the present invention, where FIG. 2A illustrates an exemplary trumpet, FIG. 2B illustrates an exemplary tuba, FIG. 2C illustrates an exemplary flugel horn, FIG. 2D illustrates an exemplary trumpet, FIG. 2E illustrates an exemplary French horn, and FIG. 2F illustrates an exemplary euphonium, FIG. 2G illustrates an exemplary bassoon, and 2H illustrates an exemplary trombone, euphoneum in accordance with an embodiment of the present invention. Those skilled in the art, in light of the present teachings will recognize that the instruments may be susceptible to damage if left uncovered. Wooden instruments may chip, crack, and warp. Brass instruments may bend due to the soft characteristic of brass. Further, the instruments include various small intricate components such as valves, springs, keys, and slides that may cause the instrument to play out of tune if damaged. The instrument cover provides the protection for the instrument to help eliminate these damages. The instrument may include, without limitation, woodwinds, and brass. Specifically, the instrument cover may be configured to cover myriad instruments, including, without limitation, a tuba, a flugelhorn, a trombone, a euphonium, a French horn, a saxophone, a trumpet, a flute, a clarinet, a coronet, and an oboe.

Figure 3A:
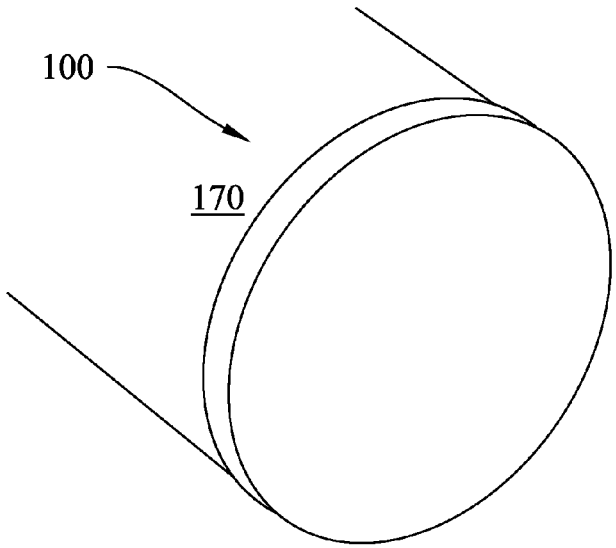
FIGS. 3A, 3B, and 3C illustrate top and bottom views of an exemplary instrument cover, where
Figure 3B:
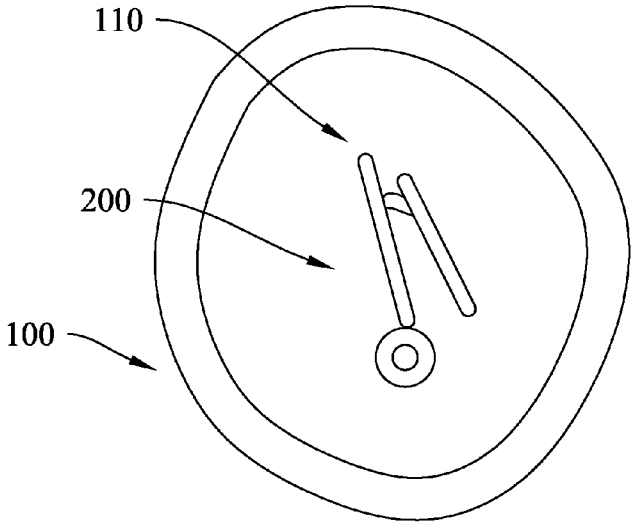
Figure 3C:
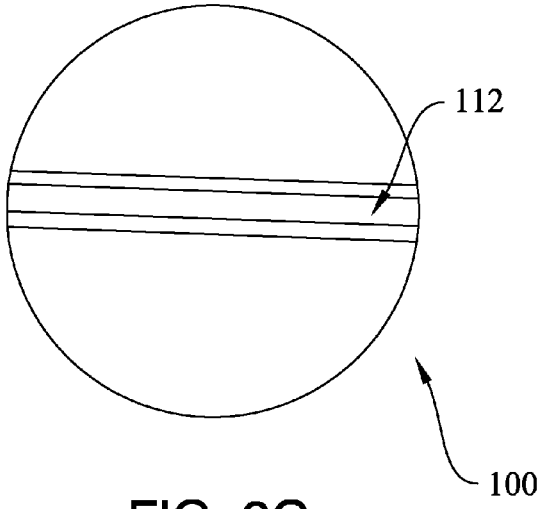

FIGS. 3A, 3B, and 3C illustrate top and bottom views of an exemplary instrument cover, where FIG. 3A illustrates a bottom view of an empty exemplary instrument cover, FIG. 3B illustrates a top view of an exemplary instrument inside an exemplary instrument cover with the top removed for viewing, and FIG. 3C illustrates the top of the cover with a handle in accordance with an embodiment of the present invention. In one embodiment of the present invention, the instrument cover may include a multiplicity of layers. In one embodiment of the present invention, the instrument cover may include an inner layer for engaging the instrument. The inner layer may provide a close, but not fully snug fit over the instrument. In this manner, the instrument cover may not snag or excessively rub against the instrument. In one embodiment of the present invention, the instrument cover may include at last one intermediate layer for insulating and retaining the form of the instrument cover. In yet another embodiment, two layers may include a soft fabric to engage the instrument and for the exterior surface. In yet another embodiment, three layers may include a soft inner layer for engaging the instrument, at least one intermediate layer that provides insulation, and a decorative exterior layer for aesthetics and identification.

Those skilled in the art, in light of the present teachings will recognize that the instrument cover may be configured to cover an instrument without requiring that the instrument be disassembled. In this manner, the covered instrument may be positioned on an instrument stand ready to be utilized instantly for facilitated accessibility and availability. Also, by covering instrument fully assembled, the instrument may withstand less attrition to the joints and components from repetitive assembling and disassembling.

Figure 4A:
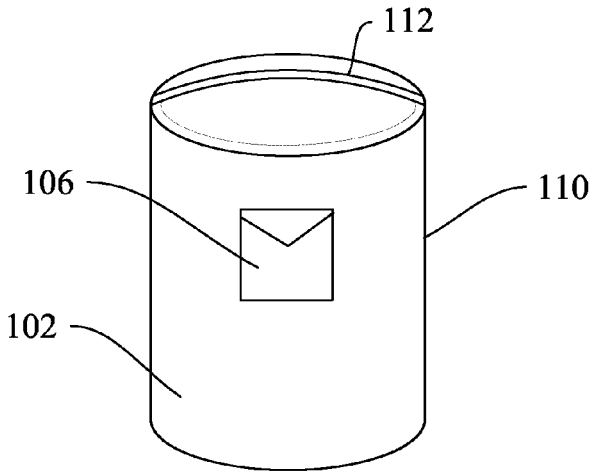
FIGS. 4A and 4B illustrate top views and bottom views of an exemplary instrument cover, in accordance with an embodiment of the present invention, where
Figure 4B:
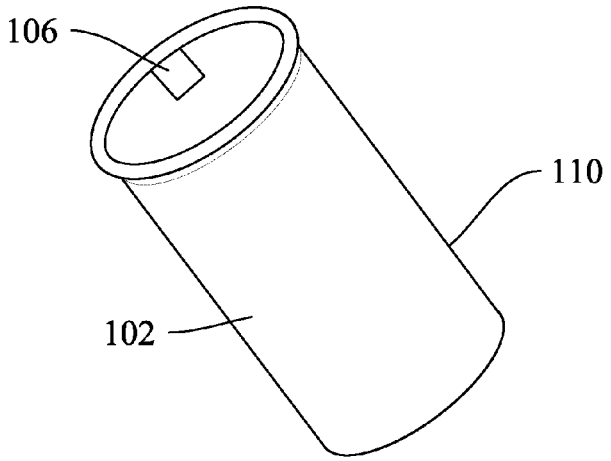

FIGS. 4A and 4B illustrate top views and bottom views of an exemplary instrument cover, in accordance with an embodiment of the present invention, where FIG. 4A illustrates a top view with an exemplary handle, and FIG. 4B illustrates a bottom view with access to an exemplary inner layer, in accordance with an embodiment of the present invention. In one embodiment of the present invention, the exterior layer may include a handle for orienting and positioning the instrument cover on or off of the instrument. The strap may securely join with the body portion.

Figure 5:
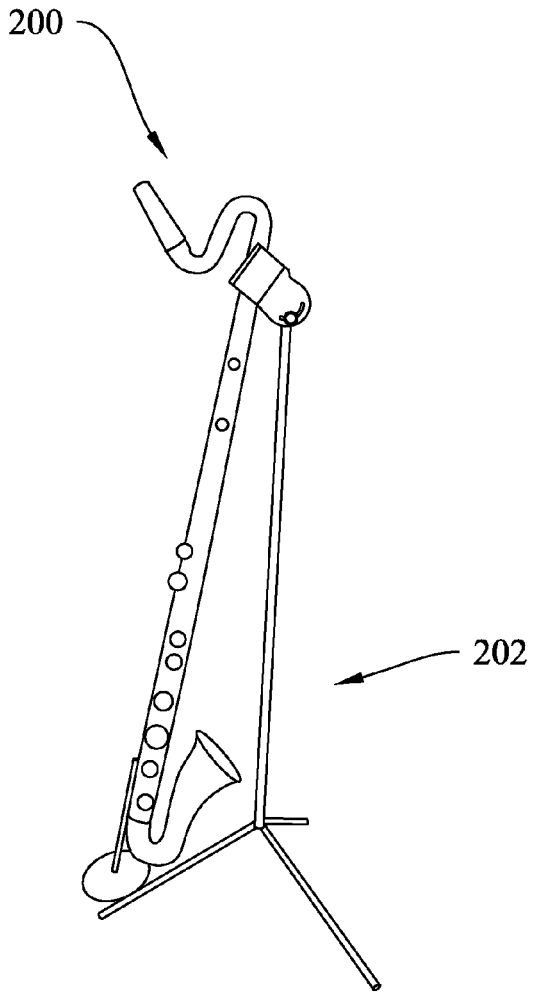
FIG. 5 illustrates an exemplary bass clarinet on an exemplary instrument stand, in accordance with an embodiment of the present invention.

FIG. 5 illustrates an exemplary bass clarinet on an exemplary instrument stand, in accordance with an embodiment of the present invention. In one embodiment of the present invention, the instrument may position on the instrument stand fully assembled. Those skilled in the art, in light of the present teachings will recognize that a fully assembled, easily accessible instrument may provide more incentive to utilize the instrument than an instrument that requires assembly. In one embodiment, the instrument cover may be configured to encapsulate a fully assembled instrument, and operable to easily disengage from the instrument.

Figure 6:
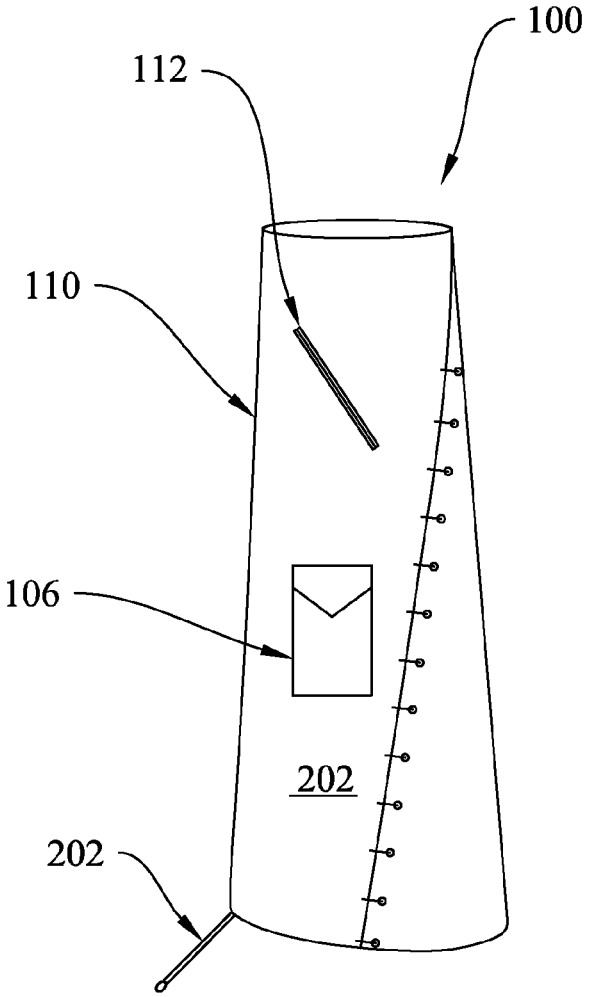
FIG. 6 illustrates a detailed perspective view of an exemplary instrument cover with an exemplary intermediate layer stitched down, and an exemplary handle, and exterior pocket in accordance with an embodiment of the present invention.

FIG. 6 illustrates a detailed perspective view of an exemplary instrument cover with an exemplary intermediate layer stitched down, and an exemplary handle, and exterior pocket, in accordance with an embodiment of the present invention. In one embodiment of the present invention, the exterior layer and the at least one intermediate layer may be stitch sewn over the inner layer. The stitch may orient along a longitudinal axis of the instrument cover. In one embodiment, a zipper may be utilized, whereby accessing the instrument may be facilitated. In some embodiments, the handle may include a loose strap that facilitates removal of the instrument cover, so that the instrument cover slides off the instrument with a slight tug on the strap.

Figure 7:
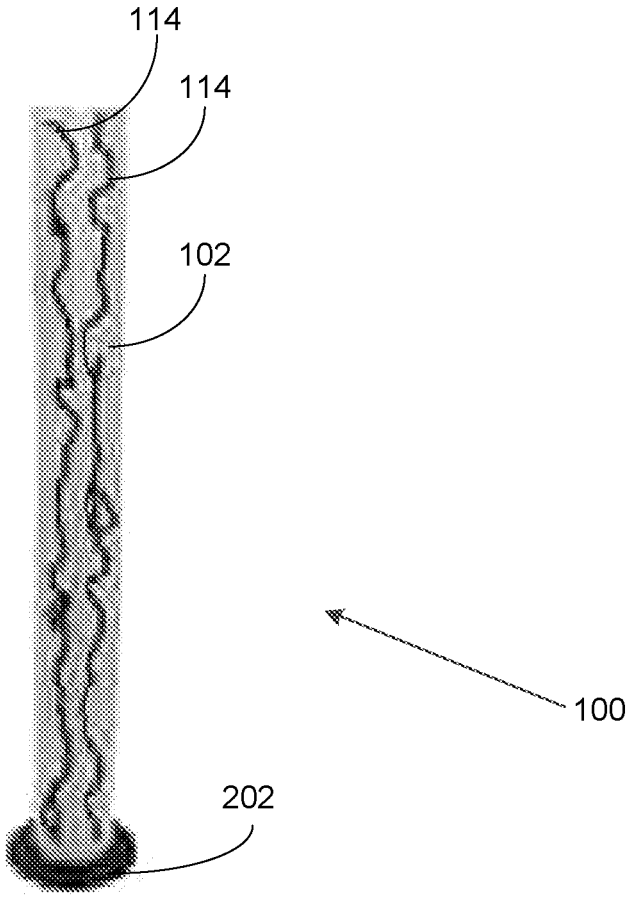
FIG. 7 illustrates a sectioned view of an exemplary instrument cover with at least one wire positioned between the inner layer and the intermediate layer, in accordance with an embodiment of the present invention.

FIG. 7 illustrates a sectioned view of an exemplary instrument cover with at least one wire positioned between the inner layer and the intermediate layer, in accordance with an embodiment of the present invention. In one embodiment of the present invention, the instrument cover may provide thermal energy to the instrument through the use of at least one wire 114. Each wire may receive electrical power from a power source, to generate the thermal energy. Those skilled in the art, in light of the present teachings, will recognize that heating a brass instrument may create a more comfortable performance.

In one alternative embodiment, the instrument cover may include an audio portion that mimics the type of instrument inside the instrument cover. In this manner, the instrument may be identified more easily when the body portion fully encapsulates the instrument. In yet another alternative embodiment, the body portion provides sufficient texture and depth to serve as a seat cushion while a musician is performing. In yet another alternative embodiment, the instrument cover compacts into a small shape for easy storage and portability. In yet another alternative embodiment, the instrument cover includes a beverage pouch and a straw for refreshing the musician during a performance.

All the features or embodiment components disclosed in this specification, including any accompanying abstract and drawings, unless expressly stated otherwise, may be replaced by alternative features or components serving the same, equivalent or similar purpose as known by those skilled in the art to achieve the same, equivalent, suitable, or similar results by such alternative feature(s) or component(s) providing a similar function by virtue of their having known suitable properties for the intended purpose. Thus, unless expressly stated otherwise, each feature disclosed is one example only of a generic series of equivalent, or suitable, or similar features known or knowable to those skilled in the art without requiring undue experimentation Having fully described at least one embodiment of the present invention, other equivalent or alternative methods of implementing a multilayered instrument cover for protecting and making more accessible instruments according to the present invention will be apparent to those skilled in the art. Various aspects of the invention have been described above by way of illustration, and the specific embodiments disclosed are not intended to limit the invention to the particular forms disclosed. The particular implementation of the multilayered instrument cover for protecting and making more accessible instruments may vary depending upon the particular context or application. By way of example, and not limitation, the multilayered instrument cover for protecting and making more accessible instruments described in the foregoing were principally directed to encapsulate musical instruments implementations. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A cover comprising:

a body portion, said body portion being configured to be operable for encapsulating an instrument, said body portion comprising an open bottom end being configured to enable said instrument to be inserted into the cover with said instrument being supported on an instrument stand, said body portion further comprising an inner layer, said inner layer being configured to engage said instrument, said body portion further comprising an intermediate layer, said intermediate layer being configured to provide a shape to said body portion and to retain said shape with said open bottom being supported on a bottom portion of said instrument stand to, said body portion further comprising an exterior layer, said exterior layer disposed to overlay said intermediate layer, said exterior layer being configured to provide an exterior surface for said body portion.

2. The cover of claim 1, wherein said cover is operable to protect said instrument.

3. The cover of claim 2, in which said cover comprises a multiplicity of layers.

4. The cover of claim 3, in which said body portion comprises a multiplicity of sections.

5. The cover of claim 4, wherein said multiplicity of sections are configured to join together to encapsulate said instrument.

6. The cover of claim 5, wherein at least one fastener secures said multiplicity of sections together.

7. The cover of claim 6, in which said body portion comprises at least one moisture and/or odor absorbing portion.

8. The cover of claim 7, wherein said at least one moisture and/or odor absorbing portion is disposed to position in a lower inside portion of said body portion.

9. The cover of claim 8, wherein said intermediate layer is operable to substantially conform to a shape of said instrument.

10. The cover of claim 9, in which said intermediate layer comprises an insulation portion.

11. The cover of claim 10, wherein said exterior layer and said intermediate layer are configured to sew onto said inner layer.

12. The cover of claim 11, in which said exterior layer comprises at least one pouch.

13. The cover of claim 12, wherein said at least one pouch is configured to contain at least one instrument component.

14. The cover of claim 13, in which said exterior layer comprises a handle.

15. The cover of claim 14, wherein said handle is configured to be operable to position said cover on and/or off said instrument.

16. The cover of claim 15, in which said exterior layer comprises a decorative surface.

17. The cover of claim 16, wherein said decorative surface is configured to identify said instrument.

18. The cover of claim 17, wherein at least one wire provide thermal energy to said instrument, said at least one wire being disposed to position between said inner layer and said intermediate layer is substantially assembled.

19. A method for using a cover comprising:

Steps for positioning an instrument on an instrument stand;

Steps for orienting said cover to encapsulate said instrument with said instrument being supported on said instrument stand;

Steps for engaging said instrument with an inner layer;

Steps for conforming a shape of an intermediate layer to a shape of said instrument with said shape of said intermediate layer being retained with said cover being supported on a bottom portion of said instrument stand; and Steps for obtaining at least one instrument component from at least one pouch on an exterior layer.

20. A cover consisting of:

a body portion, said body portion being configured to be capable of encapsulating an instrument, said body portion comprising an open bottom end being configured to enable said instrument to be inserted into the cover with said instrument being supported on an instrument stand, said body portion comprising a multiplicity of sections, said multiplicity of sections being configured to join together to encapsulate said instrument, said body portion further comprising an inner layer, said inner layer being configured to engage said instrument, said body portion further comprising an intermediate layer, said intermediate layer being configured to provide a shape to said body portion and to retain said shape with said open bottom being supported on a bottom portion of said instrument stand, said intermediate layer comprising an insulation portion, said body portion further comprising an exterior layer, said exterior layer disposed to overlay said intermediate layer, said exterior layer being configured to provide an exterior surface for said body portion, said exterior layer comprising at least one pouch, said at least one pouch being configured to contain at least one instrument component, said exterior layer further comprising a handle, said handle being configured to be operable to position said cover on and/or off said instrument.

* * * * *